US006099344A

United States Patent [19]

Chadbourne

[11] Patent Number: 6,099,344

[45] Date of Patent: Aug. 8, 2000

[54] ELECTRICAL CONNECTOR WITH A CLAMPING SCREW HAVING AN INSULATING PORTION

[75] Inventor: Richard Chadbourne, Merrimack, N.H.

[73] Assignee: Framatome Connectors USA, Inc., Fairfield, Conn.

[21] Appl. No.: 09/309,525

[22] Filed: May 11, 1999

[51] Int. Cl.[7] ..... H01R 4/24

[52] U.S. Cl. ..... 439/416; 439/781; 439/791; 439/812

[58] Field of Search ..... 439/416, 411, 439/415, 431, 781, 791, 812, 793, 810

[56] References Cited

U.S. PATENT DOCUMENTS

| | | | |
|---|---|---|---|
| 2,299,989 | 10/1942 | Johnson | 439/416 |
| 3,094,366 | 6/1963 | Harmon, Jr. | 439/416 |
| 3,876,279 | 4/1975 | Underwood | 439/797 |
| 4,247,159 | 1/1981 | Fruchard | 339/95 R |
| 4,640,571 | 2/1987 | Walter et al. | 339/242 |
| 4,985,003 | 1/1991 | Francois et al. | 439/781 |
| 5,494,462 | 2/1996 | Auclair | 439/810 |
| 5,664,971 | 9/1997 | Coy | 439/791 |

FOREIGN PATENT DOCUMENTS

| | | |
|---|---|---|
| 2459560 | 1/1981 | France . |
| 2498016 | 7/1982 | France . |
| 2596209 | 6/1989 | France . |
| 2746220 | 9/1997 | France . |
| 2174851 | 11/1986 | United Kingdom . |

OTHER PUBLICATIONS

Burndy Electrical Catalog, pp. A–29, B–5.

*Primary Examiner*—Gary F. Paumen
*Assistant Examiner*—Tho D. Ta
*Attorney, Agent, or Firm*—Perman & Green, LLP

[57] ABSTRACT

An electrical connector comprising a housing part, a cap part, and a clamp screw. The housing part has a conductor receiving channel formed therein. The cap part is removably connected to the housing part. The clamp screw is threadably mounted to the cap part to clamp a first conduct or located in the conductor receiving channel of the housing part to the housing. The clamp screw has means for connecting a second conductor to an insulated portion of the first conductor. The connecting means comprise the clamp screw having a contact surface disposed to capture a terminal of the second conductor between the contact surface and the first conductor.

14 Claims, 2 Drawing Sheets

ELECTRICAL CONNECTOR WITH A CLAMPING SCREW HAVING AN INSULATING PORTION

BACKGROUND OF THE INVENTION

1. Field of the Invention

The present invention relates to an electrical connector and, more particularly, to an electrical connector for tapping insulated conductors.

2. Prior Art

U.S. Pat. No. 4,247,159 discloses an electrical connector for use in making tap connections to conductors. This electrical connector comprises a two part housing carrying two contact members and a bolt with which the housing parts can be urged together to close the contact. U.S. Pat. No. 4,640,571 discloses an electrical connector which is provided with a housing, and a cap carrying a clamp member for clamping a wire between the clamp member and the housing. U.S. Pat. No. 4,985,003 discloses a branching electrical connector which comprises two jaws, and a clamping device for clamping the jaws together.

SUMMARY OF THE INVENTION

In accordance with a first embodiment of the present invention, an electrical connector is provided. The electrical connector comprises a housing part, a cap part, and a clamp screw. The housing part has a conductor receiving channel formed therein. The cap part is a removably connected to the housing part. The clamp screw is threadably mounted to the cap part to clamp a first conductor located in the conductor receiving channel to the housing. The clamp screw has means for connecting a second conductor to an insulated portion of the first conductor. The connecting means comprise the clamp screw having a contact surface disposed to capture a terminal of the second conductor between the contact surface and the first conductor.

In accordance with a second embodiment of the present invention, an electrical connector is provided. The electrical connector comprises a housing part, a cap part, and a clamp screw. The housing part has a conductor receiving channel formed therein. The cap part is removably connected to the housing part. The clamp screw is threadably mounted to the cap part. The clamp screw is mounted to the cap part to clamp a first conductor located in the conductor receiving channel to the housing. The clamp screw has a shoulder formed therein. The shoulder defines a penetrating portion of the clamp screw for penetrating through insulation of a first conductor. The shoulder further defines a terminal seating surface for seating a terminal of a second conductor.

In accordance with a third embodiment of the present invention, an electrical connector is provided. The electrical connector has a first part, a second part, and a clamping screw. The first part has a conductor receiving channel formed therein. The second part is removably connected to the first part. The clamping screw is mounted to the second part to clamp a first conductor located in the conductor receiving channel to the first part. The clamping screw has an end with a general stepped shape which forms a penetrating tip and a shoulder. When the clamp screw clamps the first conductor, the penetrating tip penetrates through insulation on the first conductor, and the shoulder clamps a terminal of a second conductor. The terminal of the second conductor is located between the shoulder and the first conductor when the shoulder clamps the terminal of the second conductor.

In accordance with a method of the present invention, a method for connecting a first conductor to a second insulated conductor is provided. The method comprises the steps of providing an electrical connector having a housing assembly and a screw, locating a portion of the second conductor in the housing assembly, placing a terminal of the first conductor between the screw and the second connector, and clamping the second conductor to the housing assembly with the screw. The screw is threadably mounted to the housing assembly. The screw has a piercing tip, and a shoulder formed therein. The second conductor is located in a conductor receiving channel of the housing assembly. The terminal of the first conductor is placed between the shoulder of the screw and the second conductor. When the screw clamps the second conductor to the housing assembly, the piercing tip of the screw penetrates through insulation on the second conductor, and the shoulder biases the terminal of the first conductor towards the second conductor. This seats the terminal of the first conductor against the shoulder of the screw.

BRIEF DESCRIPTION OF THE DRAWINGS

The foregoing aspects and other features of the present invention are explained in the following description, taken in connection with the accompanying drawings, wherein:

FIG. 1A is a perspective view of a second preferred embodiment of the clamping screw used with the electrical connector shown in FIG. 1.

DETAILED DESCRIPTION OF THE PREFERRED EMBODIMENT

Figure 1:
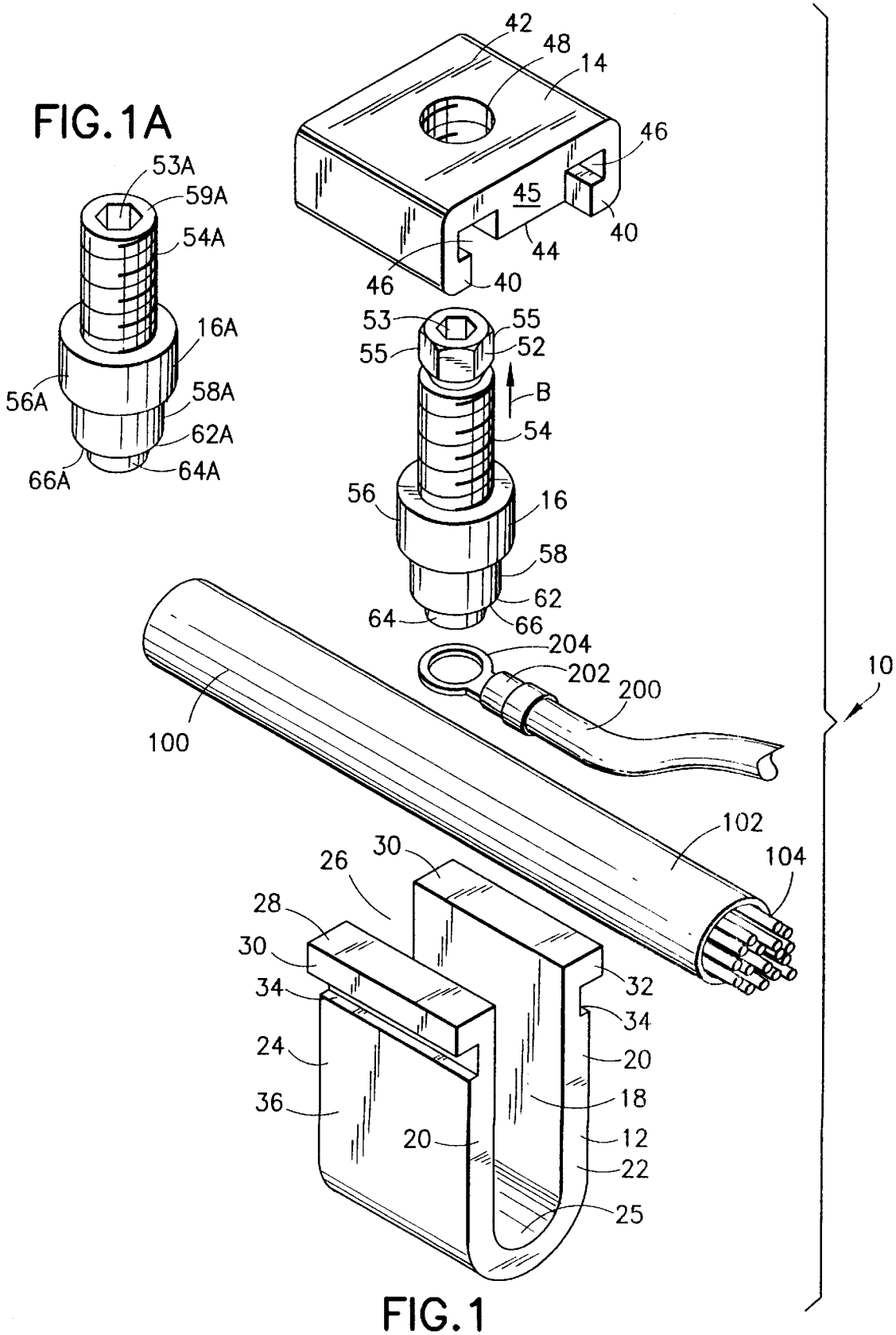
FIG. 1 is an exploded perspective view of an electrical connector, incorporating features of the present invention, for connecting a first conductor and a second conductor, the electrical connector including a clamping screw which is shown in a first preferred embodiment.

Referring to FIG. 1, there is shown an exploded perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
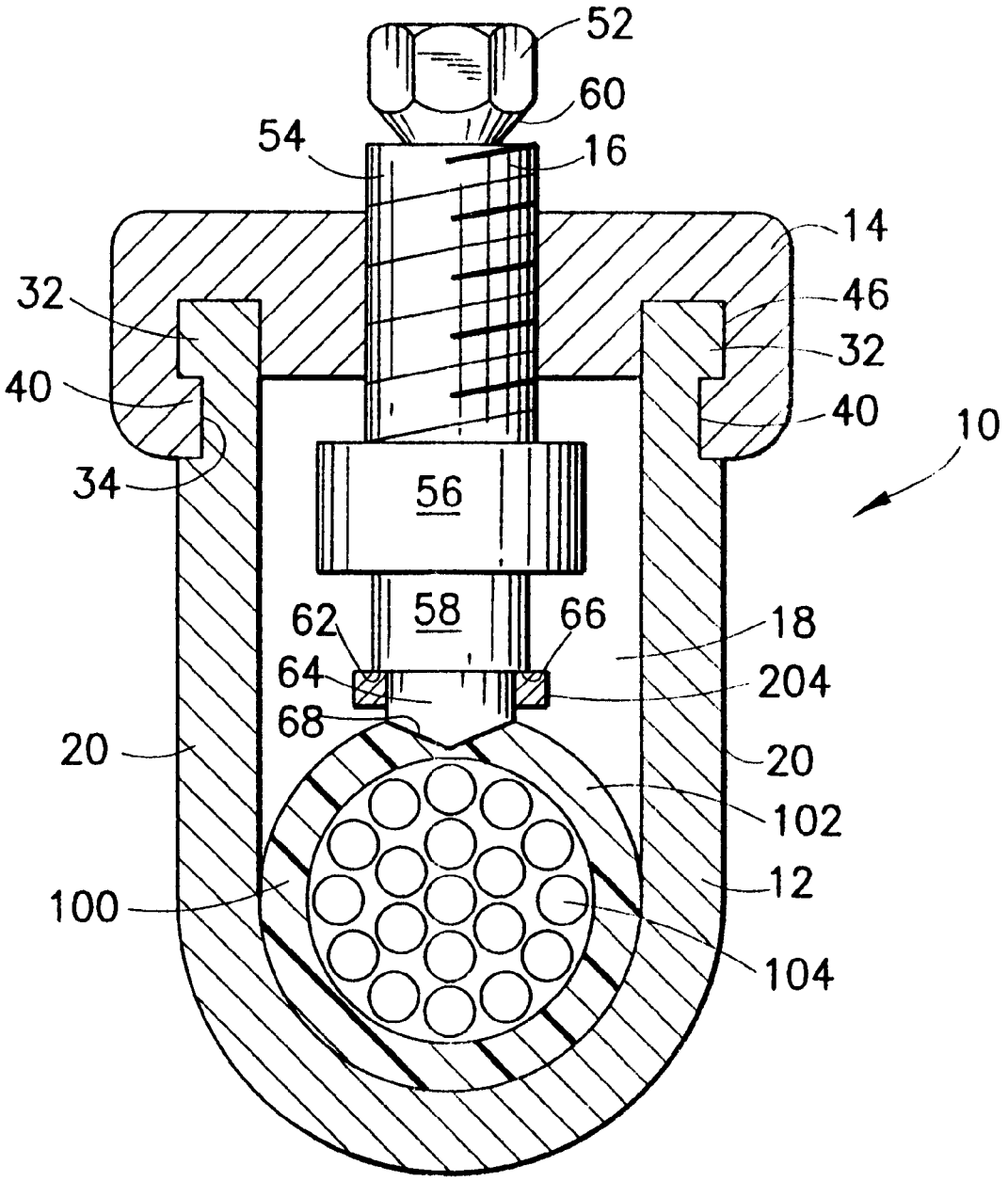
FIG. 2 is a cross-sectional elevation view of the electrical connector shown in FIG. 1.

Referring also to FIG. 2, the electrical connector 10 generally comprises a housing part 12, a cap part 14 and a clamping bolt or screw 16. The cap part 14 is removably connected to the housing part 12 to interlock the cap to the housing of the connector. The clamping screw 16 is adjustably mounted to the cap part 14. The electrical connector 10 may be assembled at any otherwise accessible location along an insulated service conductor 100 in order to tap the conductor 100 and connect the connector 10 to the service conductor 100. A secondary conductor 200 is also connected to the electrical connector 10. The electrical connector 10, thus, connects the secondary conductor 200 to the service conductor 100. The electrical connector 10 in FIGS. 1 and 2 is shown as having a general configuration of a meter sensor retrofit kit for attaching a sensor conductor to a large insulated service conductor 100. Though the present invention will be described with particular reference to the electrical connector for a meter sensor retrofit kit shown in FIGS. 1–2, the present invention applies equally to other electrical connectors for tapping insulated conductors and connecting secondary conductors to the tapped conductors.

Referring still to FIGS. 1 and 2, the housing part 12 of the electrical connector 10 is a one piece member made from aluminum or other suitable material which may be either metal or plastic. Preferably, the housing part 12 has a general U-shaped configuration. The U-shaped configuration of the housing part 12 defines a conductor receiving slot 18 between the side walls 20 of the housing part 12. The conductor receiving slot 18 is open at the front and rear ends 22, 24 of the housing part 12. The opening 26 of the conductor receiving slot 18 is located at the top 28 of the housing part 12. In alternate embodiments, the housing part of the connector may have any other suitable shape, such as for example a general block shape with an open slot extending therethrough, to receive a conductor therein. In the preferred embodiment, the width of the conductor receiving slot 18 in the housing part 12 is sufficient to receive therein a large insulated service aluminum (Al) or copper (Cu) conductor 100 having an average size of for example about 300 kcmil. In alternate embodiments, the width of the conductor receiving slot provided in the housing part may vary to correspond to other large insulated conductors ranging in size from about 3 AWG to about 750 kcmil. The curvature of the bottom 25 of the conductor receiving slot 18 generally conforms to the outer radius of the insulated service conductor 100.

The side walls 20 of the housing part 18 of the electrical connector 10 are flanged at the top 28 (see FIG. 1). The flanges 30 cantilever outwards from the corresponding side walls 20, away from the conductor receiving slot 18. The flange 30 on each of the side walls 20 forms a guide rail 32 for coupling the housing part 12 with the cap part 14 of the connector 10. Each of the side walls 20 of the housing part 12 further includes a slide groove 34. The slide grooves 34 are of sufficient width and depth to provide a general running fit with rails 40 on the cap part 14 of the connector 10 when the cap part 14 is mated to the housing part 12 as shown in FIG. 2. The slide grooves 34 are formed in the outer sides 36 of the side walls 20 immediately below the outwardly projecting guide rails 32 of the housing part 12. However, in alternate embodiments, the slide grooves may be formed in the inner surfaces of the side walls and may be displaced as desired from the guide rails on the housing part. In other alternate embodiments, the guide rails of the housing part may project in any other suitable direction to allow sliding mating with the cap part of the connector.

The cap part 14 of the electrical connector 10 is a one piece member made from aluminum or other suitable material which may be either metal or plastic. The cap part 14 has a width sufficient to span across the conductor receiving slot 18 in the housing part 12. The top 42 of the cap part 12 is substantially flat. The bottom 44 of the cap part 12 has a pair of tracks 46 formed therein. The tracks 46 are shaped to complement the opposing guide rails 32 of the housing part 12. The tracks have a width and depth sufficient to form a general running fit with the guide rails 32 on the housing part when the cap part 14 and housing part 12 of the connector 10 are assembled. The tracks 46 define a key section 45 which projects downward between the tracks 46 (see FIG. 1). Guide rails 40 also depend downward from the bottom 44 of the cap part 14. The guide rails 40 project inward as shown in FIGS. 1 and 2 to enter the mating slide grooves 34 in the housing part when the housing part and cap part are mated. The cap part 14 has a threaded through hole formed therein for mounting clamp screw 16 to the cap part. The through hole 48 is located relative to the tracks 46 in order that when the cap part 14 is assembled to the housing part 12, the through hole 48 in the cap part is substantially centered over the conductor receiving slot 18 of the connector 10.

FIGS. 1 and 2 show a first preferred embodiment of the clamp screw used with the electrical connector 10 of the present invention. In this preferred embodiment, the clamp screw 16 generally comprises a head 52, a threaded section 54, an insulation section 56, and a lower contact section 58. The head 52 and threaded section 54 are connected to the lower contact section 58 by the insulation section 56. The head 52 of the clamp screw 16 has a generally hexagonal shape, though the head of the screw may have any other shape with an adequate number of faces to allow a user to apply a turning torque to the screw. As shown in FIG. 1, the head 52 in this case may also have a keyed socket 53 to allow insertion of a conformal drive tool into the head 52. As seen best in FIG. 2, the head 52 has an undercut section 60 at the interface between the head 52 and the threaded section 54 of the clamp screw 16. The undercut section 60 in the head 52 of the screw 16 is sized to allow the head 52 to shear-off when a turning torque of a predetermined magnitude is applied to the head 52. The head 52 has a width across the corners 55 of the head 52 to allow the head to be inserted through the threaded through hole 48 in the cap part 14 of the connector 10. The threaded section 54 of the clamp screw 16 has an adequate diameter and thread profile to be threaded into the threaded hole 48 of the cap part 14.

The insulation section 56 of the clamp screw 16 is made from an insulating material such as for example a hard ceramic or other such material. The insulating section 56 electrically isolates the threaded section 54 and head 52 of the clamp screw from the lower contact section 58. The insulation section 56 has an outer diameter which is larger than the diameter of the threaded section 54. Hence, the insulation section 56 is excluded from the threaded hole 48 in the cap part 14. Accordingly, due to the placement of the wider insulation section 56 below the threaded section 54, the clamp screw 16 is threaded into the hole 48 from the bottom 44 of the cap part 14 as indicated by arrow B in FIG. 1. The diameter of the insulation section 56, however, is smaller than the width of the conductor receiving slot 18 and allows the insulation section to be admitted into the conductor receiving slot 18 in the housing part 12 of the connector 10.

The lower contact section 58 of the clamp screw 16 has a generally stepped cylindrical shape. The stepped shape of the contact section 58 defines a shoulder 62 and an insulation penetrating section 64 extending downwards from the shoulder 62. The shoulder 62 forms a lower contact surface 66 for seating a contact 204 on a terminal connector 202 crimped to an end of the secondary conductor 200. The secondary conductor 200 shown in FIGS. 1 and 2 may be a small sensor conductor, such as for example a 12 AWG SOL Cu conductor as may be used with the meter sensor kit. However, other suitably sized secondary conductors may be used with the electrical connector 10 of the present invention. The terminal connector 202 on the secondary conductor shown in FIGS. 1 and 2 has a general ring shaped contact 204, though the contact may have a generally forked or semi-circular shape. The insulation penetrating section 64 of the clamp screw 16, which for illustration purposes is shown as having a general cylindrical shape, is sized to allow the penetrating section 64 to be inserted through the hole in the ring shaped contact 204 so that the ring contact 204 may be seated against the contact surface 66 of the screw 16 (see FIG. 2). The tip or penetrating edge 68 of the insulation penetrating section 64 is suitably shaped to cut, pierce or otherwise penetrate through the insulation 102 of the insulated service conductor 100 when the clamp screw clamps the service conductor 100 to the connector 10.

Referring now to FIG. 1A, there is shown a perspective view of a second preferred embodiment of the clamp screw used with the electrical connector 10 of the present invention. The clamp screw 16A in this second preferred embodiment is substantially similar to the clamp screw 16 described above and shown in FIGS. 1 and 2. As in the first preferred embodiment, the clamp screw 16A of the second preferred embodiment comprises a threaded section 54A connected by a protuberant insulation section 56A to a stepped lower contact section 58A. The stepped lower contact section defines a shoulder 62A which provides a contact surface 66A and a insulation penetrating section 64A projecting from the shoulder 62A. Unlike the first preferred embodiment, the clamp screw 16A of the second preferred embodiment has no head section atop the threaded section 54A of the screw. Instead, the top 59A of the threaded section 54A has a keyed socket 53A formed therein to receive a conformal portion of a drive tool (not shown) with which a user may turn the screw 16A in the connector.

The electrical connector 10 may be installed substantially at any desired location along the length of the insulated service conductor 100 substantially as described below. Referring now again to FIGS. 1 and 2, prior to installation, the electrical connector 10 is in a disassembled state similar to the condition of the connector 10 shown in FIG. 1. The housing part 12 of the connector is then placed on the insulated service conductor 100 so that the conductor 100 is located in the conductor receiving slot 18 of the housing part 12. With the conductor 100 located in the conductor receiving slot 18 of the housing part 12, the cap part 14 of the connector 10 is mounted to the housing part 12. The clamp screw 16 is mounted to the cap part 14 at any time prior to but no later than the mating of the cap part 14 to the housing part 12 of the electrical connector 10. The clamp screw 16 is mounted to the cap part 14 by inserting the screw 16, head 52 first, into the threaded hole 58 through the bottom 44 of the cap part 12 as indicated by arrow B in FIG. 1. The clamp screw 16 is threaded into the hole 58 until the head 52 emerges from the top 42 of the cap part 14 and the insulation section 56 of the screw abuts the bottom 44 of the cap part 12 (not shown). In this position, the insulation section 56 of the screw acts as a stop preventing the screw 16 from being threaded too far out of the cap part 12. The cap part 14 is mated to the housing part 12 of the electrical connector 10 by initially aligning the guide rails 32 on the housing 12 with the tracks 46 on the cap part 14 and then sliding the cap part 14 on the guide rails 32 over the housing part 12. As the guide rails 32 of the housing slide into the tracks 46 in the cap, conversely the rails 40 on the cap slide lengthwise into the slide grooves 34 in the housing. When the cap part 14 and housing part 12 of the electrical connector 10 are fully mated, the clamp screw 16 threaded into the cap part 14 is located within the conductor receiving slot 18, of the housing part, substantially over the insulated service conductor 100 in the slot 18. The secondary conductor 200 may then be connected with the electrical connector 10 to the insulated service conductor 100. To connect the secondary conductor 200 to the service conductor 100, the clamp screw 16 is threaded downwards towards the service conductor 100. The contact 204 on the terminal 202 of the secondary conductor 200 is placed around the insulation penetration portion 64 of the clamp screw 16 before the clamp screw contacts the insulation on the service conductor. The user then merely continues to thread the clamp screw 16 into the service conductor 100 to effect a connection between the secondary conductor 200 and the service conductor 100. To thread the clamp screw 16 into the insulated service conductor 100, the user applies a turning torque to the head 52 of the screw 16 using an appropriate drive tool (not shown). As the clamp screw 16 is threaded down into the connector 10, clamping the service conductor 100 against the housing part 12, the cap part 14 is biased away from the housing part 12 interlocking the rails 32, 40 on the cap and housing and substantially locking the cap part 14 to the housing part 12 of the electrical connector 10. Additional torque may then be applied so that the insulation penetrating section 64 of the clamp screw 16 penetrates through the insulation 102 on the service conductor 100 to contact the metal conductor 104 underlying the insulation. As the insulation penetrating section 64 of the clamp screw penetrates through the insulation of the service conductor, the insulation 102 biases the ring contact 204 of the terminal 202 on the secondary conductor 200 against the contact surface 66 of the contact section 62 of the clamp screw 16. The contact 204 of the terminal 202 on the secondary conductor 200 is captured between the contact surface 66 of the screw and the service conductor 100. The insulation penetrating section 64 of the screw 16 has a predetermined length such that, when the penetrating section 64 penetrates through the service conductor insulation 102 effecting electrical contact between the conductor 100 and the contact section 58 of the screw 16 without crushing the conductor, the conductor insulation 102 presses the ring contact 204 against the contact surface 66 on the screw 16 thereby effecting electrical contact between the secondary conductor 200 and the contact section 58 of the screw. Accordingly, the electrical connector 10 now connects the secondary conductor 200 to the insulated service conductor 100. The head 52 of the clamp screw 16 shears off at the predetermined turning torque value. The predetermined turning torque value is sufficient to drive the insulation penetrating section 64 of the screw 16 through the service conductor insulation 102 to effect an electrical connection between the second conductor 200 and the service conductor 100 as described above, but is otherwise not sufficient to crush the service conductor 100. Thus, the shear off head 52 of the clamp screw 16 prevents a user from applying excessive clamping pressure on and damaging the service conductor 100. The insulation section 56 of the clamp screw 16 isolates the head 52 and threaded section 54 of the screw 16, and correspondingly the rest of the electrical connector 10 from the live lower connection section 58 of the screw which is in contact with the live service conductor 100. This allows the user to complete installation of the connector 10 on a live service conductor 100.

The present invention provides an electrical connector 10 which can be quickly installed to connect a secondary, tap, or sensor conductor 200 to a service conductor 100 at almost any accessible location along the service conductor. The electrical connector 10 of the present invention is ideally suited for backfit installation of sensor wires on existing installed service conductors in existing facilities. In existing facilities, the service conductors or cables may be hidden or obscured by various structures or equipment which hinders access to the installed service conductors. This condition increases the difficulty in reaching the hidden service conductors in order to connect a tap conductor thereto, the difficulty being magnified by the consideration that the service conductors may be live which complicates installation of the tap line to the service conductor with the connectors of the prior art. The electrical connector 10 of the present invention can be installed directly on a live service conductor avoiding the uncertainty of whether the conductor being worked on has been unpowered. With the electrical connector 10 of the present invention, the user at installation need handle only two major sub-assemblies of the connector 10, the housing part 12 and the cap part 14 with the screw 16 already mounted therewith. Furthermore, the cap part 14 and the housing part 12 of the connector are quickly mated by easy slide on action. The electrical connection between the tap conductor 200 and the service conductor 100 is then readily effected by merely threading down the clamp screw 16. The shear off head 52 of the screw 16 ensures that the user will not damage the service conductor when connecting the tap conductor to the service conductor.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing part with a conductor receiving channel formed therein;

a cap part removably connected to the housing part, the cap part having a threaded hole formed therein; and a clamp screw threadably mounted to the cap part to clamp a first conductor located in the conductor receiving channel to the housing part, the clamp screw having a threaded portion adapted to engage the threaded hole in the cap part;

wherein the clamp screw has means for connecting a second conductor to an insulated portion of the first conductor, the connecting means comprising the clamp screw having a contact surface disposed to capture a terminal of the second conductor between the contact surface and the first conductor, and wherein the clamp screw has a drive head projecting from the threaded portion of the clamp screw, the drive head being sized to pass through the threaded hole in the cap part when the clamp screw is mounted in the cap part.

2. An electrical connector as in claim 1, wherein the connecting means comprise the clamp screw having a penetrating tip for penetrating through insulation of the first conductor and connecting the second conductor to the first conductor when the clamp screw clamps the first conductor to the housing part of the electrical connector.

3. An electrical connector as in claim 1, wherein the drive head of the clamp screw is a shear-off drive head.

4. An electrical connector as in claim 1, wherein the clamp screw has a head section with a socket formed therein.

5. An electrical connector as in claim 1, wherein the clamp screw has an insulation section disposed on the clamp screw to electrically isolate an electrical conductive portion of the clamp screw from a portion of the clamp screw contacting the cap part of the connector.

6. An electrical connector as in claim 1, wherein the housing part has guide grooves formed therein adapted to receive complementing slide rails formed in the cap part to effect slide mounting of the cap part to the housing part.

7. An electrical connector as in claim 1, wherein the terminal of the second conductor is captured between the contact surface of the clamp screw and the insulated portion of the first conductor.

8. An electrical connector comprising:

a housing part with a conductor receiving channel formed therein;

a cap part removably connected to the housing part; and a clamp screw threadably mounted to the cap part to clamp a first conductor located in the conductor receiving channel to the housing part;

wherein the clamp screw has a shoulder formed therein, and a penetrating portion for penetrating through insulation on the first conductor, the penetrating portion projecting from the shoulder, wherein the shoulder defines a terminal seating surface for seating a terminal of a second conductor, and wherein when the clamp screw clamps the first conductor to the housing part, the second conductor seated on the seating surface of the clamp screw is biased by the first conductor against the seating surface.

9. An electrical connector as in claim 8, wherein when the clamp screw clamps the first conductor to the housing part, the penetrating portion penetrates through insulation on the first conductor and the terminal of the second conductor seated on the seating surface of the clamp screw is connected to the first conductor.

10. An electrical connector as in claim 8, wherein the clamp screw includes an insulation portion disposed to isolate an engagement portion of the clamp screw from an electrically conductive portion of the clamp screw.

11. An electrical connector as in claim 8, wherein the clamp screw has a drive head projecting from an engagement portion of the clamp screw, the drive head being sized to pass through a threaded mounting hole for mounting the clamp screw to the cap part of the connector, and wherein the drive head is a shear-off drive head.

12. An electrical connector having a first part with a conductor receiving channel formed therein, a second part removably connected to the first part, a clamping screw mounted to the second part to clamp a first conductor located in the conductor receiving channel to the first part, wherein the improvement comprises:

the clamping screw having an end with a general stepped shape forming a penetrating tip and a shoulder, wherein when the clamping screw clamps the first conductor, the penetrating tip penetrates through insulation on the first conductor, and the shoulder clamps a terminal of a second conductor, which terminal is located between the shoulder and the first conductor.

13. An electrical connector as in claim 12, wherein the clamping screw includes an insulation section disposed to isolate a portion of the clamping screw contacting the second part of the connector from an electrically conductive portion of the clamping screw.

14. An electrical connector as in claim 12, wherein the clamping screw has a shear-off drive head projecting from a threaded portion of the clamping screw, the drive head having a size adapted to pass through a clamp screw mounting hole in the second part of the connector.

* * * * *